United States Patent [19]

Masuda

[11] 4,349,003

[45] Sep. 14, 1982

[54] EXHAUST GAS RECIRCULATION CONTROL VALVE

[75] Inventor: Yoshihiko Masuda, Toyota, Japan

[73] Assignee: Toyota Jidosha Kogyo Kabushiki Kaisha, Aichi, Japan

[21] Appl. No.: 160,324

[22] Filed: Jun. 17, 1980

[30] Foreign Application Priority Data

Jun. 29, 1979 [JP] Japan ..... 54-89923[U]

[51] Int. Cl.[3] ..... F02M 25/06

[52] U.S. Cl. ..... 123/568

[58] Field of Search ..... 123/568

[56] References Cited

U.S. PATENT DOCUMENTS

| | | | |
|---|---|---|---|
| 3,989,018 | 11/1976 | Beier | 123/568 |
| 4,106,449 | 8/1978 | Matsumoto et al. | 123/568 |
| 4,266,524 | 5/1981 | Perez | 123/568 |

FOREIGN PATENT DOCUMENTS

| | | | |
|---|---|---|---|
| 5397219 | 1/1952 | Japan . | |
| 53-21330 | 2/1978 | Japan | 123/568 |
| 54-105621 | 8/1979 | Japan | 123/568 |
| 54-153922 | 12/1979 | Japan | 123/568 |
| 55-23381 | 2/1980 | Japan | 123/568 |
| 55-84847 | 6/1980 | Japan | 123/568 |

*Primary Examiner*—Wendell E. Burns

*Attorney, Agent, or Firm*—Stevens, Davis, Miller & Mosher

[57] ABSTRACT

An exhaust gas recirculation control valve for preventing carbon and the like contained in the exhaust gas from attaching to the inner wall surface of exhaust gas paths, through which the exhaust gas from an engine of a motor car passes, thus decreasing the diameters of the paths with time. This exhaust gas recirculation control valve is provided in a passageway, through which the exhaust gas from the engine is recirculated into an intake air-fuel mixture, a path being of a frusto-conical shape in cross-section and having a progressively larger diameter toward an exhaust gas inlet is formed upstream of the minimum diameter portion, and the inner diameter of the smallest diameter end of said path being of the frusto-conical shape in cross-section in the vicinity of said minimum diameter portion is larger than the inner diameter of said minimum diameter portion. The path being of the frusto-conical shape in cross-section may be formed of a valve housing separately manufactured of a valve seat.

3 Claims, 19 Drawing Figures

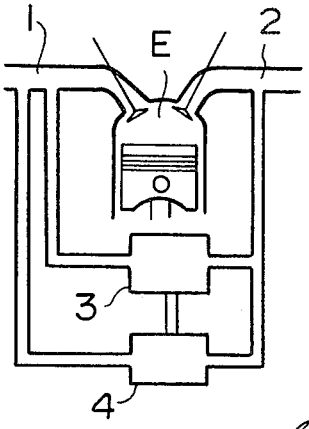
FIG. 1
FIG. 2
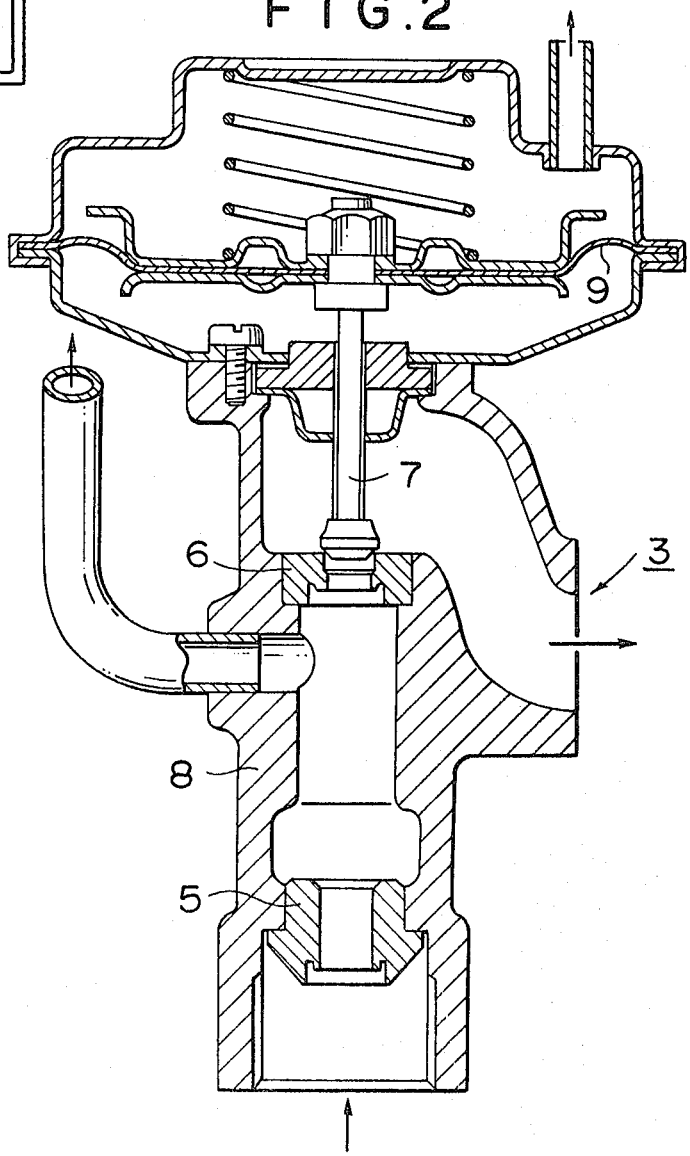

EXHAUST GAS RECIRCULATION CONTROL VALVE

BACKGROUND OF THE INVENTION

1. Field of the Invention

This invention relates to exhaust gas recirculation control valves used in recirculating the exhaust gas from an engine of a motor car.

2. Description of the Prior Art

In general, in the engines of motor cars, as shown in FIG. 1, exhaust gas recirculation control valves 3, which are briefly referred to as the "EGR valves", are provided in a path for communicating an intake system 1 of the engine E with an exhaust system 2 thereof, and the exhaust gas recirculation control valves 3 are adapted to be controlled by a control device 4.

As shown in FIG. 2, the exhaust gas recirculation valves 3 are arranged such that two exhaust gas recirculation control valves 5, 6 are provided in a valve housing 8 successively from an inlet, for receiving the exhaust gas from the engine E, and a valve body 7 is adapted to approach or recede from the control valve 6 provided downwardly in accordance with the action of a diaphragm 9.

However, with the exhaust gas recirculation control valves 3 of the type as described, carbon and the like contained in the exhaust gas tend to be adhesively attached to the interiors of the control valves 5 and 6 constituting throttles. The attachment of carbon and the like thereto results in decreased diameters in paths in the control valves 5 and 6, thus presenting such a disadvantage that the flow rate fluctuates with time.

Heretofore, there have been used control valves 15 and 16 shown in FIGS. 3 and 4, respectively, as the abovedescribed control valves 5 and 6. With these conventional control valves 15 and 16 being not provided at inner wall surfaces of the paths thereof with effective means for gathering carbon and the like, the attachment of carbon and the like on the inner wall surfaces of the paths thereof tends to decrease the diameters of the paths, thus presenting the disadvantage that the flow rate fluctuates with time as described above.

SUMMARY OF THE INVENTION

This invention has been developed to obviate the abovedescribed problems of the prior art, and has as its object the provision of exhaust gas recirculation control valves capable of effectively preventing the attachment of carbon and the like contained in the exhaust gas onto the wall surfaces of the exhaust gas paths thereof, which results in decreased diameters of the exhaust gas paths with time.

In order to accomplish the abovedescribed object, according to the present invention, the exhaust gas recirculation control valves provided in a passageway for recirculating the exhaust gas from the engine into an intake air-fuel mixture has such a characteristic feature that a path being of a frusto-conical shape tapered off from its exhaust gas inlet is provided in a valve seat upstream of the minimum diameter portion of the valve seat, and the inner diameter of the tapered-off end of this frusto-conical path adjacent the aforesaid minimum diameter portion is made larger than the minimum diameter portion. According to the present invention, a cylindrical path may be provided at a connecting portion between the frusto-conical path and the minimum diameter portion, so that said minimum diameter portion and the cylindrical path can define a stepped portion for collecting a substance adhesively attached thereonto. Furthermore, according to the present invention, an annular ridge raised toward the center of the valve may be provided at the aforesaid connecting portion between the frusto-conical path and the minimum diameter portion. Further, according to the present invention, the frusto-conical path may be formed of a separate valve housing.

With the arrangement of the present invention, a portion, where carbon and the like contained in the exhaust gas in concentratingly collected, is formed in the paths of each of the exhaust gas recirculation control valves, whereby the diameters of the paths are not decreased partially, thereby enabling obviation of such disadvantages observed with the prior art that carbon and the like tend to decrease the diameters of valves at a comparatively early stage, whereby the flow rate is reduced.

BRIEF DESCRIPTION OF THE DRAWINGS

FIG. 1 is an explanatory view showing the outline of the exhaust gas recirculation system, into which can be built the exhaust gas recirculating valve according to the present invention;

FIG. 2 is a schematic sectional view showing the exhaust gas recirculation control valves to which the present invention is applicable;

DETAILED DESCRIPTION OF THE PREFERRED EMBODIMENT

Figure 5:
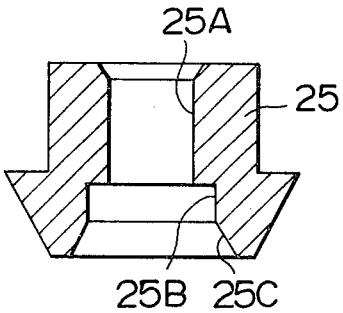
FIG. 5 is a sectional view showing an embodiment of the valve seat of the exhaust gas recirculation control valve according to the present invention.

FIG. 5 is a sectional view showing an embodiment of the exhaust gas recirculation control valve according to the present invention. In this embodiment, a path in an exhaust gas recirculation control valve 25 comprises a minimum diameter portion 25A having a cylindrical cross-section and provided downstream as viewed from the inlet of the exhaust gas, and a cylindrical path 25B having a diameter larger than that of the minimum diameter portion and provided upstream of the minimum diameter portion 25A. A stepped portion is formed between the cylindrical path 25B and the minimum diameter portion 25A, said stepped portion constituting a section, where carbon and the like are concentratingly collected, which will hereinafter be described. Formed upstream of the cylindrical path 25B is a path 25C being of a frusto-conical shape in cross-section, the exhaust gas inlet side of which has a larger diameter. This path 25C having the frusto-conical shape in cross-section is constructed such that the inner diameter of the smaller diameter end thereof is larger than the inner diameter of the aforesaid minimum diameter portion 25A.

Figure 6:
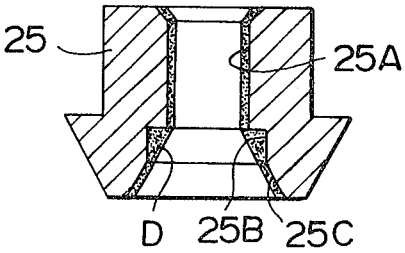
FIG. 6 is a sectional view showing the conditions of the attachment of deposit in the valve seat of the exhaust gas recirculation control valve shown in FIG. 5.

In this embodiment, as shown in FIG. 6, the deposit such as carbon contained in the exhaust gas is mostly accumulated at the stepped portion formed between the minimum diameter portion 25A of the control valve 25 and the cylindrical path 25B, and scarcely attached to other portions. Description will hereunder be given of this phenomenon. In general, the relation between the flow rate and the pressure difference in a control valve constituting a throttle may be given by:

$$Q = KaAj\sqrt{\frac{\Delta P}{\rho}} \quad (1)$$

wherein

Q: the flow rate,

ΔP: the pressure difference,

ρ: the density of the fluid,

Aj: the cross-sectional area of the path (the cross-sectional area of the minimum diameter portion of the control valve), and Ka: the flow coefficient (which is mainly concerned with the shape).

Now, in the exhaust gas recirculation control valve 25 of this embodiment, in the case the deposit such as carbon contained in the exhaust gas is attached to the control valve 25, the deposit D is concentratingly attached to the stepped portion formed between the minimum diameter portion 25A and the cylindrical path 25B, with the result that a substantially frusto-conical shape in cross-section is formed by the deposit D from the exhaust gas inlet end of the control valve 25 to the inlet of the minimum diameter portion 25A. The flow coefficient is increased with this change in shape, whereby Ka·Aj in the aforesaid equation (1) is not varied. Consequently, the relation between the flow rate Q and the pressure difference ΔP can be retained to be constant, so that the fluctuation with time of the exhaust gas recirculation characteristics can be prevented in the exhaust gas recirculation control valve 25 of this embodiment, thus enabling obviation of the disadvantage such as the decreased in flow rate due to decrease path diameter of the valve.

Figure 19:
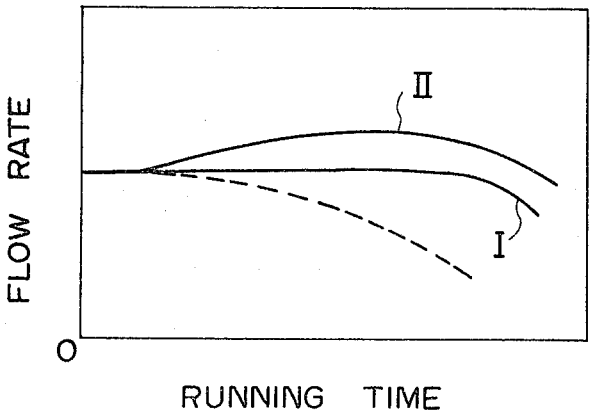
FIG. 19 illustrates the comparison between the exhaust gas recirculation control valves according to the present invention and of the prior art in exhaust gas recirculation characteristics.

More specifically, as shown in FIG. 19, in the prior art, the flow rate of the control valve is decreased with the lapse of running time as indicated by broken lines in FIG. 19. However, in this embodiment, the flow rate is maintained to be constant for a long period of running time of the motor car (see solid lines I), no fluctuation in flow rate at an early stage is observed, and, besides, it is possible to increase the flow rate with the lapse of running time as indicated by solid lines II by suitably selecting the shape of the path in the control valve.

Figure 7:
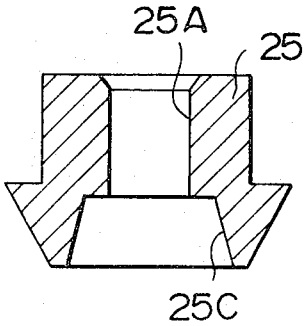
FIGS. 7 through 18 are sectional views showing other embodiments of the exhaust gas recirculation control valve according to the present invention, respectively.
Figure 8:
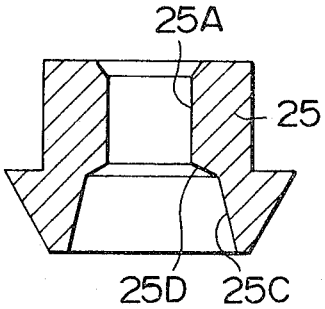

FIGS. 7 and 8 are sectional views showing other embodiments of the exhaust gas recirculation control valve according to the present invention. With these embodiments too, the diameter of the path in the control valve is not decreased due to the attachment of deposits such as carbon. On the contrary, the exhaust gas inlet portion of the path is formed into a smooth shape by carbon and the like thus attached, whereby the flow coefficient is increased, so that fluctuation with time in the exhaust gas recirculation characteristics can be effectively prevented.

Firstly, in the embodiment shown in FIG. 7, the inner path of the exhaust gas recirculation control valve 25 comprises a minimum diameter portion 25A and a path 25C being of a frusto-conical shape in cross-section and formed upstream of the minimum diameter portion 25A. Formed between the minimum diameter portion 25A and the path 25C being of a frusto-conical shape in cross-section is a stepped portion corresponding to a value of the difference in diameter between the aforesaid minimum diameter portion 25A and the inner diameter of the smallest diameter portion of the path 25C. The deposit contained in the exhaust gas, such as carbon, is concentratingly accumulated at this stepped portion. As a result, in this embodiment also, a smooth path is formed at a portion from the path 25C to the minimum diameter portion 25A, so that the flow coefficient can be increased, thereby enabling prevention of fluctuation with time in the exhaust gas recirculation characteristics.

FIG. 8 shows a further embodiment of the present invention, in which, in an exhaust gas recirculation control valve 25, another path 25D being of a frusto-conical shape in cross-section and having a progressively larger diameter toward the exhaust gas inlet is formed between the minimum diameter portion 25A and the path 25C having a frusto-conical shape in cross-section, and carbon and the like contained in the exhaust gas is concentratingly accumulated at a stepped portion formed from this path 25D to the path 25C.

Figure 9:
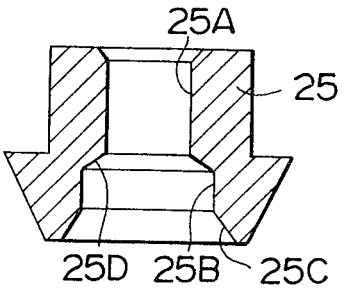

FIG. 9 shows a still further embodiment of the exhaust gas recirculation control valve 25 according to the present invention, in which a path 25B being of a cylindrical shape in cross-section is formed between the path 25C and path 25D, both of which are of frusto-conical shapes in cross-section as shown in FIG. 9. In this embodiment, the deposit such as carbon is concentratingly attached to a stepped portion formed at a portion from the path 25D to the path 25B, whereby the side of the exhaust gas inlet of the control valve 25 is formed into a smooth passageway, thus increasing the flow coefficient.

Figure 10:
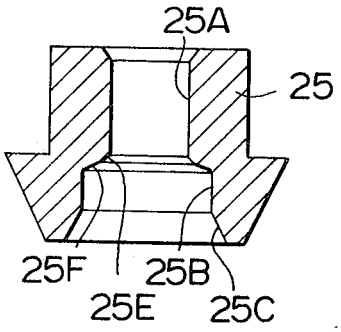

FIG. 10 shows a yet further embodiment of the exhaust gas recirculation control valve 25, in which a portion corresponding to the path 25D shown in FIG. 9, i.e., an upstream end of the minimum diameter portion 25A, has a roundish curve in cross-section as indicated at 25E, and a downstream end of the cylindrical path 25B also has a roundish curve in cross-section as indicated at 25F. This embodiment can offer such an advantage that, the curved portions 25E and 25F are provided to eliminate sharp corners, so that working of the path in the control valve 25 can be considerably facilitated.

Figure 11:
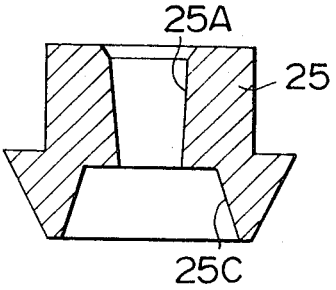

FIG. 11 shows a still further embodiment of the present invention, in which the path in the exhaust gas recirculation control valve 25 comprises a minimum diameter portion 25A and a path 25C being of a frusto-conical shape in cross-section, and the minimum diameter portion 25A in this embodiment is moderately tapered off toward the path 25C.

Figure 12:
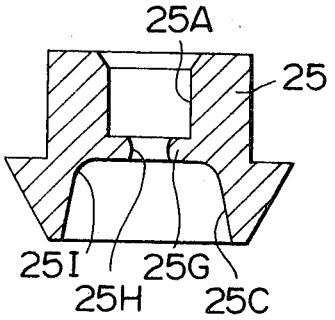

FIG. 12 shows a yet further embodiment of the present invention, in which an annular ridge 25G is provided which projects toward the center of the control valve 25 in the vicinity of a connecting portion between a minimum diameter portion 25A and a path 25C being of a frusto-conical shape in cross-section. Futhermore, the inner periphery of this annular ridge 25G has a roundish curve as indicated by 25H. Further, a curved portion 25I is formed from the annular ridge 25G to the path 25C to eliminate sharp corners, so that working can be facilitated. The provision of the annular ridge 25G as described above leads to the formation of a considerably deep stepped portion, thus further increasing the effects of concentratingly collecting the deposit such as carbon.

Figure 13:
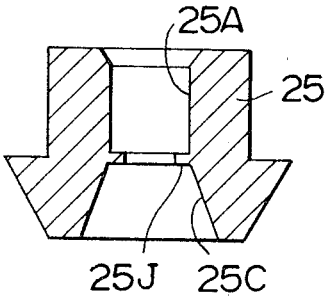

FIG. 13 shows a still further embodiment of the present invention, in which, as in the embodiment in FIG. 12, an annular ridge 25J is provided which projects toward the center of the control valve 25 in the vicinity of a connecting portion between a minimum diameter portion 25A and a path 25C being of a frusto-conical shape in cross-section. However, the annular ridge 25J in this embodiment is thinner than the annular ridge 25G in FIG. 12, and the cross-sectional area of the path at the annular ridge 25J is larger than that in FIG. 12.

Figure 14:
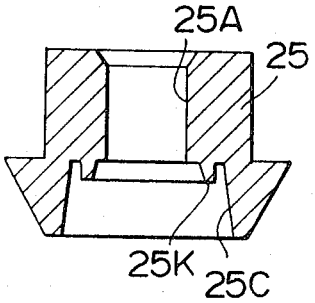

FIG. 14 shows a yet further embodiment of the present invention, in which an annular ridge 25K is provided which projects toward the exhaust gas inlet at a stepped portion formed at a portion from a minimum diameter portion 25A to a path 25C being of a frusto-conical shape in cross-section in the exhaust gas recirculation control valve 25, whereby the deposit such as carbon contained in the exhaust gas is concentratingly accumulated in an annularly recessed portion formed between this annular ridge 25K and the path 25C and at a stepped portion formed between the inner surface of this annular ridge 25K and the aforesaid minimum diameter portion 25A.

Figure 15:
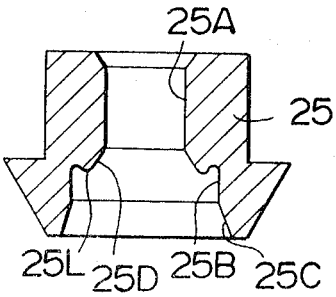

FIG. 15 shows a still further embodiment of the present invention, in which an annular ridge 25L is provided which slightly projects toward the exhaust gas inlet at a stepped portion formed between a minimum diameter portion 25A and a cylindrical path 25B. In this embodiment, the deposit such as carbon contained in the exhaust gas is attached to a stepped portion having a recess formed at a portion from the annular ridge 25L to the cylindrical path 25B, whereby a smooth exhaust gas inlet portion is formed at a portion from the minimum diameter portion 25A and a path 25C being of a frusto-conical shape in cross-section.

Figure 3:
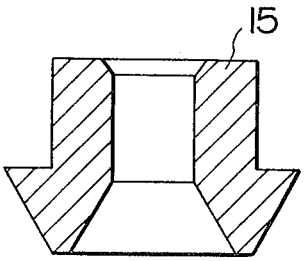
FIGS. 3 and 4 are sectional views showing the conventional exhaust gas recirculation control valves, respectively.
Figure 4:
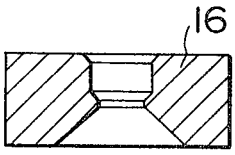
Figure 16:
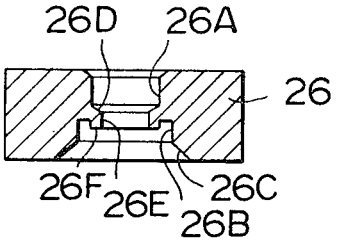

FIG. 16 is a sectional view showing another embodiment of the exhaust gas recirculation control valve 26 according to the present invention, in which this exhaust gas recirculation control valve 26 is a modification improved from the control valve 6 in FIG. 2 and the control valve 16 in FIG. 4. More specifically, in the exhaust gas recirculation control valve 26, a path 26D being of a frusto-conical shape in cross-section and tapered off toward the exhaust gas inlet is formed upstream of a portion 26A, a cylindrical path 26E is disposed upstream of this path 26D, this cylindrical path 26E is extended to an annular ridge 26F provided upstream thereof, this annular ridge 26F forms a stepped portion having a recess between itself and a cylindrical path 26B provided upstream thereof, and further a path 26C being of a frusto-conical shape in cross-section and having a progressively larger diameter toward the exhaust gas inlet is disposed contiguous to this cylindrical path 26B. This embodiment is of such an arrangement that the deposit such as carbon contained in the exhaust gas is concentratingly accumulated at a stepped portion having a recess formed from the annular ridge 26F to the cylindrical path 26B.

Figure 17:
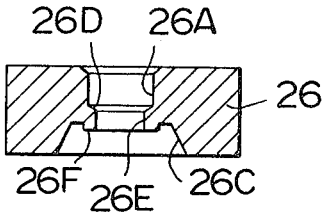

FIG. 17 is a sectional view showing a further embodiment of the exhaust gas recirculation control valve 26 according to the present invention, in which a path 26C being of a frusto-conical shape in cross-section is extended to a portion corresponding to the cylindrical path 26B in FIG. 16, with the construction other than this extension of the path 26C being substantially the same as in FIG. 16.

Figure 18:
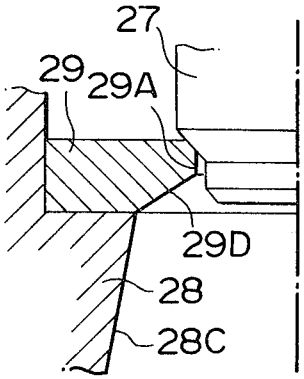

FIG. 18 shows a still further embodiment of the exhaust gas recirculation control valve according to the present invention, in which a valve seat 29 coming into contact with a valve body 27 is assembled with a valve housing 28 to form the inner path similar to those shown in the preceding embodiments. More specifically, a minimum diameter portion 29A corresponding to the minimum diameter portion 25A in the preceding embodiments is formed at the downstream side of the valve seat 29 as viewed from the exhaust gas inlet, and, for example, a path 29D being of a frusto-conical shape in cross-section and having a progressively larger diameter toward the exhaust gas inlet is at the upstream side of this minimum diameter portion 29A similarly to the path 25D being of a frusto-conical shape in cross-section shown in the embodiment of FIG. 8. Furthermore, a path 28C being of a frusto-conical shape in cross-section and having a progressively larger diameter toward the exhaust gas inlet is formed on the valve housing 28 from the upstream end of the path 29D. Consequently, in this embodiment also, a stepped portion is formed at a portion from the path 28C being of the frusto-conical shape in cross-section of the valve housing 28 to the path 29D having the frusto-conical shape in cross-section, the deposit such as carbon contained in the exhaust gas is concentratingly attached to this stepped portion, whereby a smooth exhaust gas passageway is formed at a portion from the path 28C to the minimum diameter portion 29A of the valve seat 29 to increase the flow coefficient, thereby enabling to prevent the change with time in the exhaust gas recirculation characteristics. This invention includes the construction of the control valve of the assembled type as shown in FIG. 18.

It should be understood, however, that there is no intention to limit the invention to the specific forms disclosed, but on the contrary, the invention covers all modifications, alternate constructions and equivalents.

As has been described hereinabove, according to the present invention, such a phenomenon as the exhaust gas recirculation control valve having a decreased flow rate due to the decrease in the diameters of paths with time by the attachment of carbon and the like contained in the exhaust gas, resulting in the change with time in the exhaust gas recirculation characteristics, can be prevented. Further, satisfactory exhaust gas recirculation characteristics can be constantly maintained for a long period of running time of the motor car.

What is claimed is:

1. An exhaust gas recirculation control valve provided in a passageway through which an exhaust gas of an engine is recirculated into an intake air-fuel mixture, said exhaust gas recirculation control valve comprising:

a valve orifice member with a through hole defining a pass; and a valve body to open or close said pass;

said pass comprising in the following order from downstream to upstream:

a tapered seat tapering toward upstream for receiving said valve body to contact sealingly with said valve body;

a cylindrical minimum diameter portion with a same diameter of an upstream end of said tapered seat;

a stepped portion perpendicular to the minimum diameter portion facing upstream for collecting deposits;

a cylindrical pass with a diameter greater than the diameter of said cylindrical minimum diameter portion; and a frusto-conical pass tapering toward downstream, the downstream end of said frusto-conical pass having a same diameter as said cylindrical pass, whereby deposits from said exhaust gas are concentratingly attached to the stepped portion so that the deposits on the inner surface of said cylindrical minimum diameter portion, on said stepped portion, on the inner surface of said cylindrical pass and on the inner surface of the frusto-conical pass define a pass with a gradually increasing inner diameter in an upstream direction.

2. An exhaust gas recirculation control valve as set forth in claim 1, characterized in that an annular ridge projecting toward an exhaust gas inlet or the center of the valve is provided at a connecting portion between said frusto-conical pass and said minimum diameter portion.

3. An exhaust gas recirculation control valve as set forth in claim 1, wherein said frusto-conical pass is formed of a valve housing separately manufactured of the valve orifice.

* * * * *